US005988922A

United States Patent [19]

Bussiere

[11] Patent Number: 5,988,922

[45] Date of Patent: Nov. 23, 1999

[54] VALVE FOR CORRECTION FLUID DISPENSER

[75] Inventor: John Bussiere, Chelmsford, Mass.

[73] Assignee: The Gillette Company, Boston, Mass.

[21] Appl. No.: 08/457,045

[22] Filed: Jun. 1, 1995

[51] Int. Cl.[6] ..... B43K 7/12

[52] U.S. Cl. ..... 401/214; 401/212; 401/213

[58] Field of Search ..... 401/212, 214, 401/202, 213

[56] References Cited

U.S. PATENT DOCUMENTS

| | | | |
|---|---|---|---|
| 538,492 | 4/1895 | Askew . | |
| 554,189 | 2/1896 | Kochendarfer . | |
| 600,299 | 3/1898 | Werner . | |
| 1,485,181 | 2/1924 | Grund | 401/214 |
| 1,563,408 | 12/1925 | Sutherland . | |
| 2,425,198 | 8/1947 | Moore | 120/43 |
| 3,030,926 | 4/1962 | Sattmann | 120/42.4 |
| 3,406,657 | 10/1968 | Looper | 118/261 |
| 4,993,860 | 2/1991 | Sommer | 401/214 |
| 5,056,949 | 10/1991 | Petrillo | 401/214 |
| 5,277,510 | 1/1994 | Okamoto et al. | 401/214 |

FOREIGN PATENT DOCUMENTS

| | | | |
|---|---|---|---|
| 525186 | 9/1920 | France . | |
| 461361 | 7/1931 | France | 401/214 |
| 964045 | 7/1950 | France | 401/214 |
| 58420 | 11/1953 | France . | |
| 59710 | 7/1954 | France . | |
| 279362 | 3/1913 | Germany . | |
| 162454 | 3/1949 | Germany . | |
| 1209912 | 6/1957 | Germany . | |
| 1277703 | 9/1968 | Germany | 401/214 |
| 2654876 | 12/1976 | Germany . | |
| 3616116 | 5/1986 | Germany . | |

OTHER PUBLICATIONS

IBM Technical Disclosure Bulletin Vol. 11 No. 1 Jun. 1968.

*Primary Examiner*—Steven A. Bratlie
*Attorney, Agent, or Firm*—Donal B. Tobin; Paul Douglas; Aubrey C. Brine

[57] ABSTRACT

A correction fluid dispenser comprises a body member adapted to contain a correction fluid and a tip disposed at the forward end thereof for delivery of the fluid to a surface. The tip terminates in an orifice formed by a circular rim with a spherical ball of greater diameter than that of the rim contained in the tip. A cylindrical valve member is disposed having a forwardly facing surface contacting the ball and a plurality of axial cavities formed therein adjacent the tip inner wall for directing fluid along that wall to the spherical ball surface.

22 Claims, 5 Drawing Sheets

VALVE FOR CORRECTION FLUID DISPENSER

BACKGROUND OF THE INVENTION

The present invention relates to fluid dispensers and in particular to a correction fluid dispenser of the pencil or pen type as is generally employed for correcting typewriter or other printed errors.

Various devices are known which are employed in correcting errors occurring in typewritten material or other printed media. Many of these devices employ a pen or pencil type of structure which may be moved along the line to be erased applying the liquid substance, which is generally white in color. These devices generally have an internally spring-biased plunger which closes the discharge orifice of the device to prevent drying of the correction fluid reservoir, or as disclosed in U.S. Pat. No. 5,056,949, issued to Petrillo and assigned to the assignee of the present invention, a spherical ball may be employed which is spring-biased to ensure its contact with the paper during the erasing procedure, as well as for closure of the discharge orifice.

While the spring-biased ball has proved to be successful in achieving its intended function, it has been found that a more efficient valve arrangement than that disclosed in the aforementioned Petrillo patent may be provided which will achieve a more uniform flow of liquid to the ball, and therefore to the print to be erased, than in the prior art devices. The dispensing mechanism of the instant invention is effective in achieving these improved results by providing valve elements which retain their structural integrity under operative conditions during the life of the dispenser.

It is therefore an object of the present invention to provide a correction fluid dispenser of the pen type having a spherical ball in which the flow of fluid material to the ball is more uniform than in devices developed heretofore.

A further object of the invention is to provide a correction fluid dispenser of the type which is simple to manufacture and easy to operate.

Yet another object of the invention is to provide a correction fluid dispenser of the pencil or pen type which is simple to manufacture and has a minimum number of components.

SUMMARY OF THE INVENTION

The above objects and other objectives which will become apparent as the description proceeds are achieved by providing a correction fluid dispenser comprising a body member adapted to retain a correction fluid and a tip disposed at the forward end of the body member for delivery of correction fluid from the body member to the surface upon which the correction is to be made. The tip member has an orifice with a circular rim formed in the forward end which opens rearwardly into a tubular passage extending to and communicating with the interior of the body member. A spherical ball of greater diameter than the orifice circular rim is disposed within the tubular passage adjacent the circular rim and a valve means for metering flow of correction fluid through the tip and to said spherical ball is disposed within the tubular passage. The valve means comprises a slidable cylindrical valve member which is disposed in the tubular passage and has a substantially planar forward facing surface with a portion disposed for contacting the rearwardmost surface of the ball. The valve member further comprises a plurality of axial cavities formed thereon adjacent the wall of the tubular passage extending to an area adjacent the spherical ball. Further, the valve means comprises means for biasing the valve member into contact with the spherical ball.

The axial cavities provided on the valve member are generally formed by a plurality of flange members extending radially outwardly from the valve member, the outer edges thereof being disposed for slidable engagement with the wall of the tubular passage. The flange members may be of any number but are generally at least four in number.

The cylindrical valve member generally includes a plurality of forwardly projecting nubs disposed adjacent the circumference of the valve member planar surface. The nubs are located adjacent the spherical ball during operation of the dispenser when the ball is rolled over the planar surface. The forwardly projecting nubs are at least four in number and each nub has provided thereon a spherical surface at its forwardmost end for location adjacent the spherical ball during operation of the correction fluid dispenser. The nubs provide guidance to center the ball. Most of the ball contact is on the planar face of the valve means, however, during the operation of the correction fluid dispenser the ball may contact one or more nubs.

In a more detailed sense the valve member is generally formed of an axially disposed substantially solid body portion having a plurality of flange members extending radially outwardly therefrom with the flanges extending axially beyond the body portion in the rearward direction.

The correction fluid dispenser further may include a helical spring serving as a biasing means and contacting the rear surface of the valve member to bias the valve member into contact with the spherical ball to maintain the spherical ball into contact with the medium on which the erasure occurs, as well as to maintain the spherical ball's contact with the orifice circular rim of the tip member while corrections are not being made.

In an alternate embodiment of the invention, the correction fluid dispenser employs a valve member wherein the plurality of flanges each has a rearwardly outwardly facing surface disposed for contact with a forwardly and inwardly facing surface formed in the tubular passage in which the valve member is disposed. The flanges are formed of a resilient plastic material, and the outwardly facing surfaces and the inwardly facing surface are disposed relative to one another such that the flanges are flexed inwardly from their initial position as the valve member is forced rearwardly. The valve member is moved forwardly when force is removed from the valve member and the flanges are allowed to return to their initial position, thus creating a biasing means for the valve member forcing it into contact with the spherical ball without the employment of a separate and distinct biasing element.

BRIEF DESCRIPTION OF THE DRAWING

The foregoing and other features of the invention will be more particularly described in connection with the preferred embodiment, and with reference to the accompanying drawing, wherein.

DESCRIPTION OF THE PREFERRED EMBODIMENTS

Figure 1:
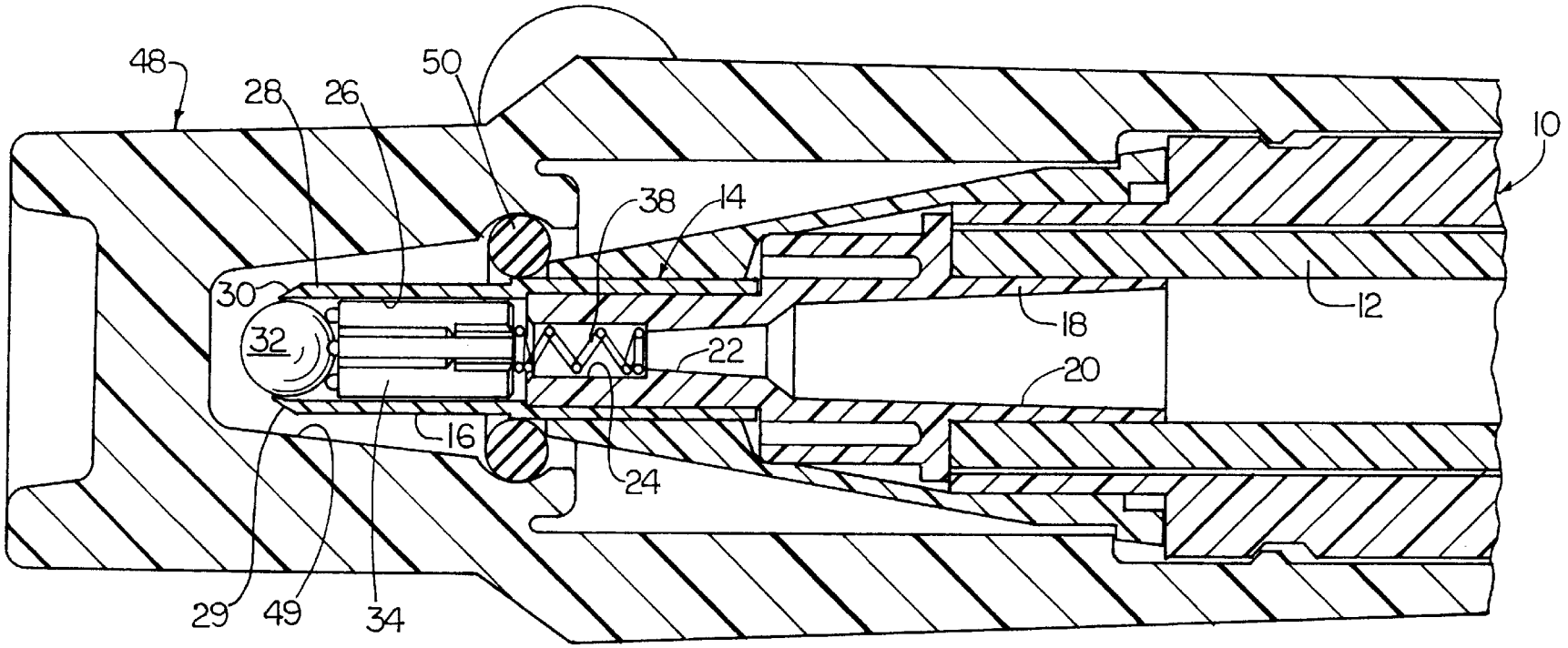
FIG. 1 is a sectional elevational view showing a portion of a correction fluid dispenser constructed in accordance with the teachings of the present invention.

Referring now to the drawing and in particular to FIG. 1 there is shown a correction fluid dispenser 10 having an elongated circular body member 12 with a cylindrical tip 14 disposed at the forward end thereof. The body member 12 is not shown in its entirety, but generally extends rearwardly axially from the tip 14 in a pen or pencil configuration for manipulation by the user, and is capable of containing a desired quantity of correction fluid composition for gravity flow from the body member.

The tip 14 is shown to be formed of two tip pieces 16 and 18 which may be a force fit one within the other and the entire tip has a rearwardmost portion of a diameter which may be a force fit into the tubular portion of the body member 12. The tip 14 is provided with a tubular passage 20 which at its rearward end opens into the body member 12 and is necked down at its forward end to provide a restrictive passage 22 having a greater diameter opening into the passage 20 and a smaller diameter opening at its forward end. The forward end of the restrictive passage 22 opens into a cylindrical cavity 24 which at its forward end enters into a main tubular passage 26 formed by a cylindrical wall 28.

The cylindrical wall 28 terminates at a circular rim 29 having an in-turned edge portion 30 which serves to retain a spherical ball 32 within the tubular passage 26.

Figure 2:
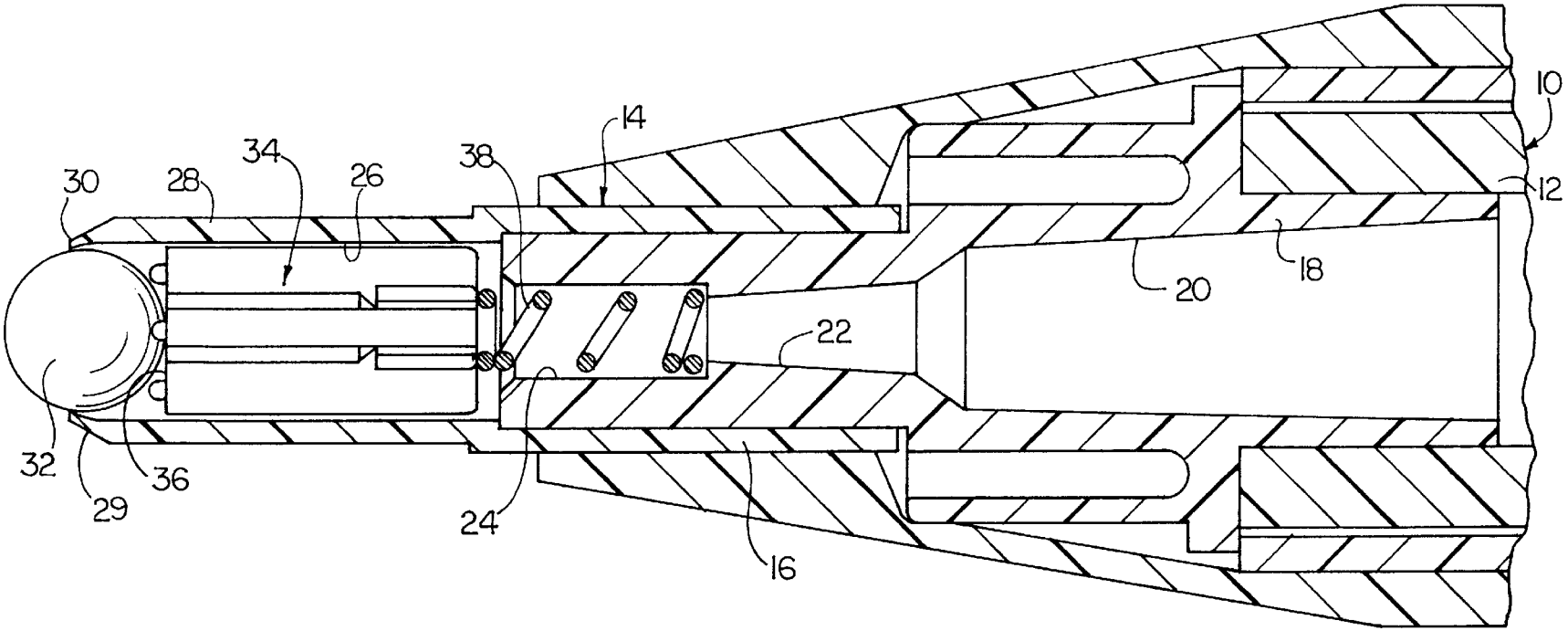
FIG. 2 is a sectional elevational view showing a portion of the structure of FIG. 1 taken on an enlarged scale for clarity.
Figure 3:
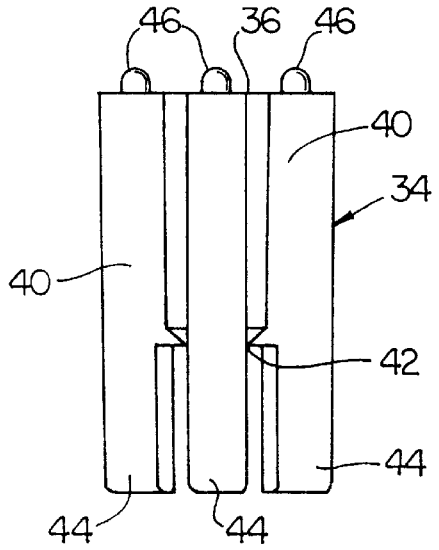
FIG. 3 is an elevational view showing an element of the valve means employed in the structure of FIGS. 1 and 2.
Figure 6:
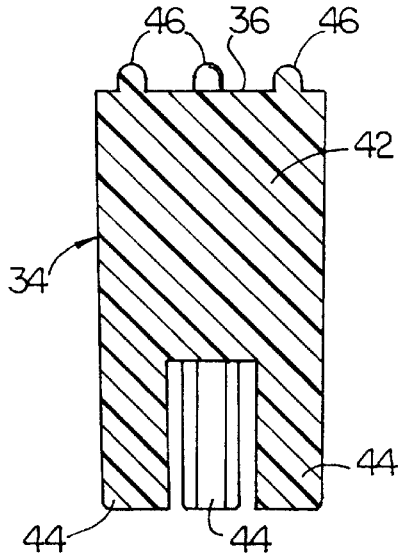
FIG. 6 is a sectional elevational view taken along the line VI—VI of FIG. 4 showing details of the structure of FIGS. 3, 4 and 5.
Figure 4:
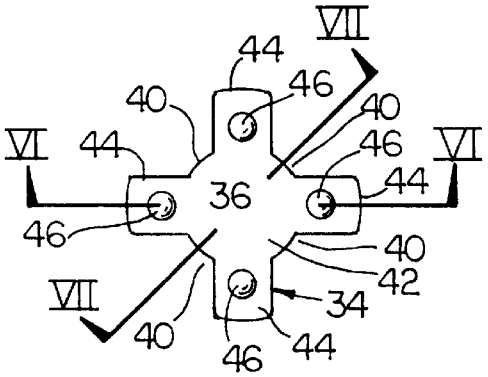
FIG. 4 is a top plan view showing details of that portion of the structure of FIG. 3.
Figure 7:
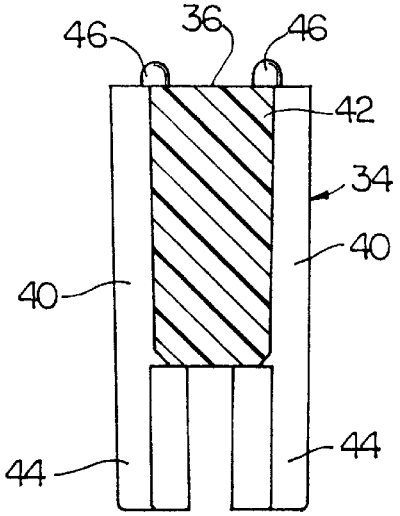
FIG. 7 is a sectional elevational view taken along the line VII—VII of FIG. 4 showing further details of the valve means element.
Figure 5:
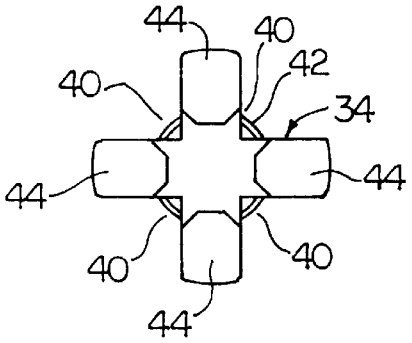
FIG. 5 is a bottom plan view showing details of the bottom portion of the structure of FIG. 3.

As best shown in FIG. 2, the spherical ball 32 is of a greater diameter than the diameter of the edge portion 30, and the two dimensions are such that over one half of the ball will remain retained within passage 26 with the ball in its forwardmost position. The ball 32 may be of any substantially hard, wear resistant material, and is generally manufactured of a stainless steel which is corrosive resistant, or of a plastic material.

Referring still to FIGS. 1 and 2, valve means such as valve member 34 is located within the tubular passage 26, the valve member having a seat surface 36 disposed in contact with the spherical ball 32. The valve member further has its rearwardmost portion contacting a helical spring 38 disposed in the cylindrical cavity 24. The helical spring 38 is manufactured of any suitable spring material, but is preferably of a corrosive resistant steel and of a spring constant which will provide a force in the area of approximately 100–200 grams on the spherical ball 32 when the ball is in its forwardmost position.

Referring now to FIGS. 3 through 7, the valve member 34 is comprised of a plurality of axial cavities 40 which are formed by a substantial solid body portion 42 having four flange members 44 equally spaced about the body portion and extending radially outwardly therefrom. It will be noted that the flange members 44 extend rearwardly beyond the body portion 42 for a distance which is less than one half the total length of the body portion. The unsupported length of the flange members 44 is minimized to maintain the rigidity of the valve member 34 in that the force from the helical spring 38 is applied directly to the rear surfaces of the flange members 44, as shown in FIGS. 1 and 2.

In addition to the seat surface 36 at the forward end of the valve member 34, four forwardly projecting elements in the form of nubs 46 extend outwardly from the valve member and are located symmetrically about the seat surface 36. Each of the nubs 46 have a spherical surface formed on the forward end thereof for location adjacent the spherical ball 32, as will be referred to during the description of operation of the correction dispenser.

The valve member 34 is generally manufactured of a plastic material such as a poly-etherimide material, which is an amorphous thermoplastic, but may be of any material which exhibits the high strength, low friction and dimensional stability qualities required by the stressed valve member. As the outer surfaces of the flange members 44 are disposed in close fitting engagement with the tubular passage 26 and must be capable of sliding in the passage while contacting the tubular passage wall during usage of the correction fluid dispenser 10, a strong and wear resistant material must be employed in the manufacture of the valve member 34.

Referring back to FIG. 1, it will be observed that the tip 14 is substantially enclosed by a cap member 48 providing an internal cavity 49 for receiving the tip 14 therein when the correction fluid dispenser 10 is not being used. In order to ensure that an airtight closure is obtained by the cap member 48, an O-ring is disposed about the inner wall of the cap member cylindrical cavity for sealingly engaging the outer wall of the tip 14.

In operation, with the cap member 48 removed the spherical ball 32 is placed in contact with an indicia on a surface to be erased and a slight force applied to the forward end of the correction dispenser 10 which is moved over the surface causing the spherical ball 32 to roll within the tubular passage 26. When the spherical ball 32 is rolled along the surface to be erased it is moved over the seat surface 36 and is pushed inwardly. The ball may then contact the spherical surface of one or more of the "centralizing" nubs 46 which as in the case of the seat surface 36 will make a point contact with the spherical ball 32. As previously indicated, the helical spring 38 is in contact with the rearwardmost surface of each of the flange members 44 causing the spherical ball 32 to remain in contact with the valve member 34 at the seat surface 36, and/or possibly with one (or more) of the nubs 46.

Referring still to FIGS. 1 and 2, with the correction fluid stored within the body member 12, flow of the fluid takes place through the tubular passage 20 as the fluid is dispensed by the spherical ball 32. From the tubular passage 20 the fluid flows through the restrictive passage 22 into the cylindrical cavity 24 and then into the tubular passage 26. At the tubular passage 26 the flow of fluid is confronted by the body portion 42 of the valve member 34 and is forced to flow along the axial cavities 40, between the flange members 44, and is therefore applied to the spherical ball 32 at its outermost surfaces rather than at the center of the ball. Thus, fresh fluid is flowing onto that portion of the ball that is being introduced to the surface upon which the erasure is to occur, rather than at the center of the ball as in prior art devices. As will be observed, the spherical ball at any time is in point contact with the seat surface 36 and also may be in point contact with one (or more) of the nubs 46, therefore employing less of the ball surface for support and presenting a greater surface area for contact by the correction fluid than has been previously obtained in devices of this type. In addition, the structure of the valve member 34 is one wherein the flow of fluid through the valve is maximized by the construction of the flange members, which maintain the structural integrity of the valve member when a force is applied by the helical spring 38.

Figure 8:
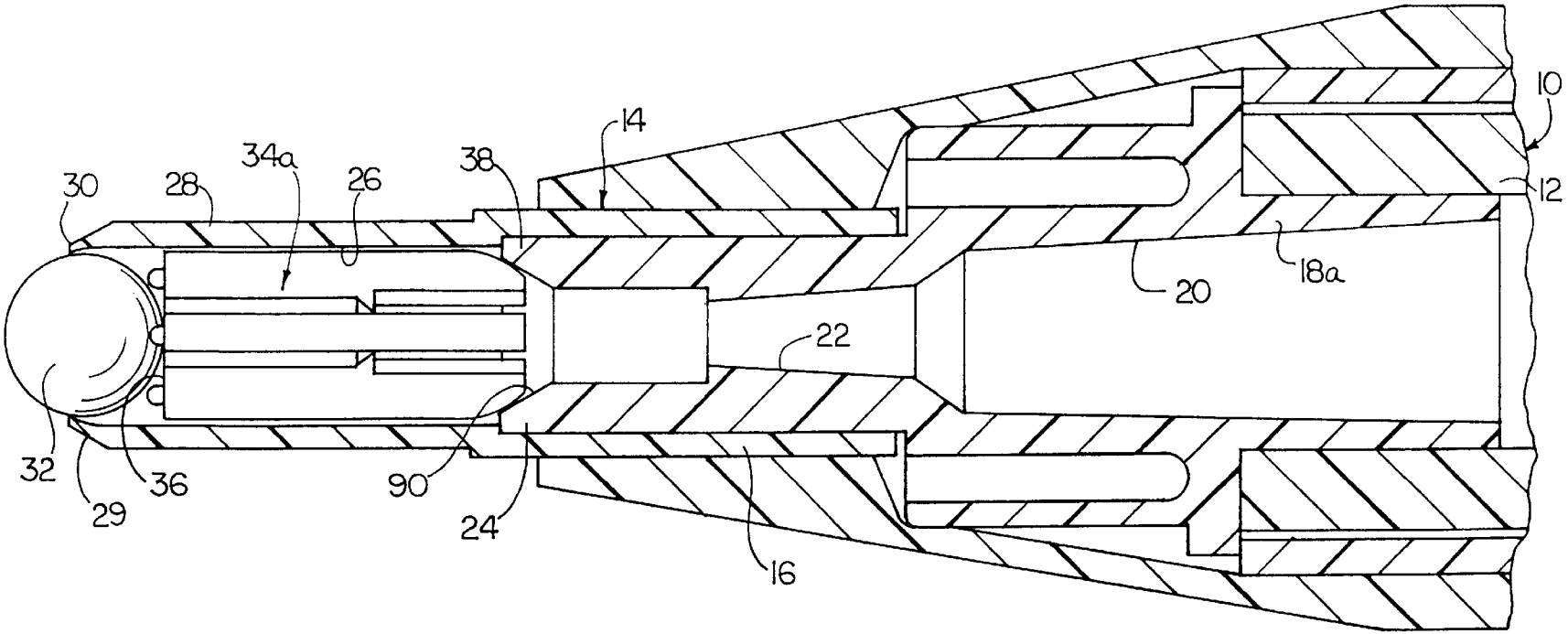
FIG. 8 is a sectional elevational view similar to FIG. 1 showing a portion of a correction fluid dispenser embodying an alternate structure of the invention.
Figure 9:
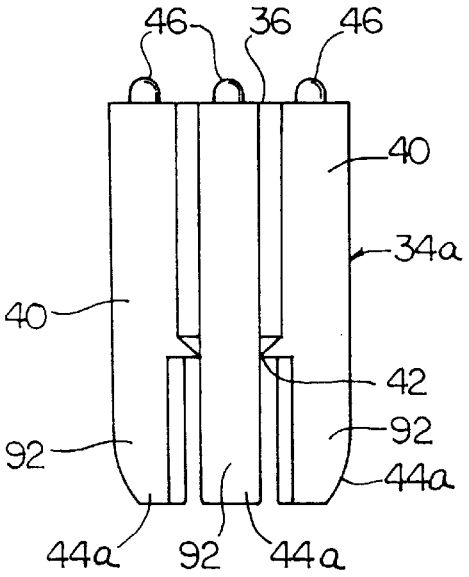
FIG. 9 is an elevational view similar to FIG. 3 showing an element of the valve means of FIG. 8.
Figure 10:
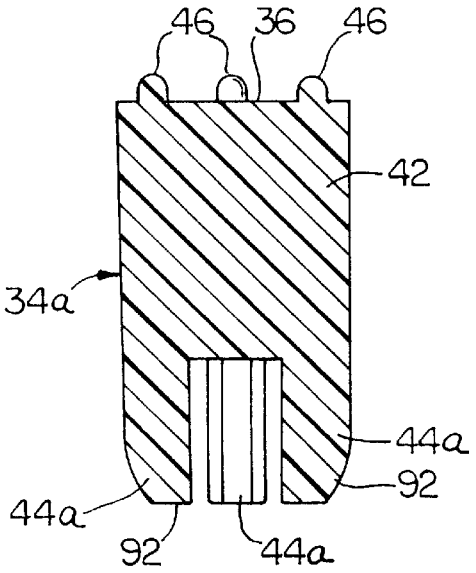
FIG. 10 is a sectional view similar to FIG. 6 showing details of the structure of FIG. 9.

Referring now to FIGS. 8 through 10 (wherein like elements to those of FIGS. 1 through 7 are given like reference numerals), an alternate embodiment of the invention is shown wherein the biasing means does not require a separate member such as helical spring 38 but wherein the valve member 34 is replaced by valve member 34*a* and tip piece 18 is replaced by tip piece 18*a*. The piece 18*a* as shown in FIG. 8 has formed at its forwardmost periphery a forwardly inwardly facing arcuate surface 90 disposed for contact with the rearmost portion of the valve member 34*a*.

As best shown in FIG. 9 and 10 the valve member 34*a* comprises four flange members 44*a* located in a similar manner to the flanges 44 of the above-described valve member 34. Each of the flanges 44*a*, however, is provided with a rearwardly outwardly facing arcuate surface 92 which in the assembly shown in FIG. 8 is disposed in contact with the surface 90 on the tip piece 18*a*. While the valve member 34 has been described as generally manufactured of a plastic material such as a poly-etherimide material, which is an amorphous thermoplastic, the material for the valve member 34*a* may be of any material which is generally plastic, and in addition to exhibiting the high strength, low friction and dimensional stability requirements set forth above also exhibits a resiliency effective to return the flanges 44*a* to their original position when the flanges are forced inwardly as will be described below.

In operation of the embodiments shown in FIG. 8, the spherical ball 32 is placed in contact with an indicia on a surface to be erased and a slight force applied to the forward end of the correction dispenser, as in the previously described embodiment. The ball 32 is forced inwardly against the valve member 34*a* and as in the previous embodiment, the erasing fluid flows along the axial cavities 40 between the flange members 44*a*, and is supplied to the spherical ball 32 and then to the surface to be erased. However, rather than contacting the helical spring 38 as in the prior embodiment, when the flanges 44*a* are forced rearwardly and the arcuate surface 92 of each flange contacts the arcuate surface 90 on the tip piece 18*a*, the flanges 44*a* each flex inwardly due to the chosen resiliency of the material from which the valve member 34 is manufactured. As the force is relieved from the ball 32 by removal of the dispenser from the media to be erased, the flange members 44*a* which have been biased inwardly return to their normal position moving the valve member 34*a* upwardly and into its original position, as shown in FIG. 8.

While it is apparent that changes and modifications can be made within the spirit and scope of the present invention, it is my intention, however, only to be limited by the scope of the appended claims. As my invention I claim:

1. A correction fluid dispenser comprising:

a body member adapted to retain a correction fluid;

tip means disposed at the forward end of said body member for delivery of correction fluid from said body member to the surface upon which a correction is to be made;

said tip means having an orifice with a circular rim formed at the forward end thereof opening into a tubular passage extending to and communicating with the interior of said body member;

a spherical ball of greater diameter than said orifice circular rim disposed within said tubular passage adjacent said circular rim;

valve means for metering flow of correction fluid through said tip means to said spherical ball;

said valve means comprising a slidable cylindrical valve member disposed in said tubular passage, said valve member comprising a substantially planar forwardly facing surface having a portion thereof disposed for contacting the rearwardmost surface of said ball;

a plurality of axial cavities formed in said valve member adjacent the wall of said tubular passage and extending to an area adjacent said spherical ball to thereby provide a plurality of channels for flow of correction fluid to said spherical ball;

means disposed adjacent the periphery of said valve member planar forwardly facing surface for centering said ball on said surface; and said valve means further comprising means for biasing said valve member into contact with said spherical ball.

2. A correction fluid dispenser as set forth in claim 1 wherein said axial cavities are formed by a plurality of flange members extending radially outwardly from said valve member, the outer edges thereof being disposed for slidable engagement with the wall of said tubular passage.

3. A correction fluid dispenser as set forth in claim 2 wherein said flanges are at least four in number.

4. A correction fluid dispenser as set forth in claim 1 wherein said means for centering said ball on said surface comprises a plurality of forwardly projecting nubs disposed adjacent the circumference of said valve member planar surface.

5. A correction fluid dispenser as set forth in claim 4 wherein said forwardly projecting nubs are at least four in number.

6. A correction fluid dispenser as set forth in claim 4 wherein each said forwardly projecting nub provides a spherical surface at its forwardmost end contactable with said spherical ball during operation of the correction fluid dispenser.

7. A correction fluid dispenser as set forth in claim 1 wherein said valve member is formed of an axially disposed substantially solid cylindrical body portion having a plurality of flange members extending radially outwardly therefrom, and wherein said flanges extend axially beyond said body portion in the rearward direction.

8. A correction fluid dispenser as set forth in claim 7 wherein said flanges extend axially beyond said body portion less than one half the length of said valve member.

9. A correction fluid dispenser as set forth in claim 1 wherein said biasing means includes a helical spring contacting a rear surface of said valve member to bias said valve member into contact with said spherical ball.

10. A correction fluid dispenser as set forth in claim 3 wherein said means for centering said ball on said surface comprises a plurality of forwardly projecting nubs disposed adjacent the circumference of said valve member planar surface.

11. A correction fluid dispenser as set forth in claim 10 wherein said forwardly projecting nubs are at least four in number.

12. A correction fluid dispenser as set forth in claim 11 wherein said forwardly projecting nubs provide a spherical surface at their forwardmost end contactable with said spherical ball during operation of the correction fluid dispenser.

13. A correction fluid dispenser as set forth in claim 12 wherein said biasing means includes a helical spring contacting a rear surface of said valve member to bias said valve member into contact with said spherical ball.

14. A correction fluid dispenser as set forth in claim 8 wherein said means for centering said ball on said surface comprises a plurality of forwardly projecting nubs disposed adjacent the circumference of said valve member planar surface.

15. A correction fluid dispenser as set forth in claim 14 wherein said forwardly projecting nubs are at least four in number.

16. A correction fluid dispenser as set forth in claim 15 wherein each said forwardly projecting nub provides a spherical surface at its forwardmost end contactable with said spherical ball during operation of the correction fluid dispenser.

17. A correction fluid dispenser as set forth in claim 1 which further includes a cap having a cylindrical cavity covering said orifice, said cap having means for sealingly engaging said tip means.

18. A correction fluid dispenser as set forth in claim 17 wherein said means for sealingly engaging said tip means comprises an O-ring disposed about the inner wall of said cap cylindrical cavity.

19. A correction fluid dispenser as set forth in claim 2 wherein each of said plurality of flanges has a rearwardly outwardly facing surface disposed for contact with a forwardly inwardly facing surface formed in said tubular passage, said flanges being formed of a resilient material, and said outwardly facing surfaces and said inwardly facing surface being disposed relative to one another whereby said flanges are flexed inwardly from their initial position as said valve member is forced rearwardly and said valve member is moved forwardly as said flanges return to their initial position to thereby form said means for biasing said valve member into contact with said spherical ball.

20. A correction fluid dispenser as set forth in claim 19 wherein each said flange outwardly facing surface is an arcuate surface.

21. A correction fluid dispenser as set forth in claim 20 wherein said tubular passage inwardly facing surface is an arcuate surface.

22. A correction fluid dispenser as set forth in claim 19 wherein said valve member is manufactured of a resilient plastic material.

* * * * *